US007482762B2

(12) United States Patent
Fukuda et al.

(10) Patent No.: US 7,482,762 B2
(45) Date of Patent: Jan. 27, 2009

(54) DISCHARGE LAMP BALLAST WITH DETECTION OF ABNORMAL DISCHARGE OUTSIDE THE ARC TUBE

(75) Inventors: Kenichi Fukuda, Neyagawa (JP); Kouji Yamashita, Yawata (JP)

(73) Assignee: Matsushita Electric Works, Ltd., Kadoma-shi (JP)

( * ) Notice: Subject to any disclaimer, the term of this patent is extended or adjusted under 35 U.S.C. 154(b) by 442 days.

(21) Appl. No.: 10/578,838

(22) PCT Filed: Apr. 22, 2004

(86) PCT No.: PCT/JP2004/005823

§ 371 (c)(1),
(2), (4) Date: May 10, 2006

(87) PCT Pub. No.: WO2005/051052

PCT Pub. Date: Jun. 2, 2005

(65) Prior Publication Data

US 2007/0052371 A1 Mar. 8, 2007

(30) Foreign Application Priority Data

Nov. 21, 2003 (JP) ..... 2003-392983
Nov. 21, 2003 (JP) ..... 2003-392984

(51) Int. Cl.
*G05F 1/00* (2006.01)

(52) U.S. Cl. ..... 315/291; 315/224; 315/209 R; 315/290; 315/119; 315/307; 315/DIG. 5; 361/88; 361/93.9

(58) Field of Classification Search ..... 315/119, 315/127, 128, 224, 225, 20 RR, 244, 247, 315/289–291, 307, 360, DIG. 5, DIG. 7; 361/79, 88, 93.9
See application file for complete search history.

(56) References Cited

U.S. PATENT DOCUMENTS

| | | | | |
|---|---|---|---|---|
| 4,587,460 | A * | 5/1986 | Murayama et al. | 315/174 |
| 5,828,177 | A | 10/1998 | Toda et al. | |
| 6,002,215 | A | 12/1999 | Yamashita et al. | |
| 7,230,389 | B2 * | 6/2007 | Takeda et al. | 315/209 M |
| 7,271,551 | B1 * | 9/2007 | Cheng | 315/291 |
| 7,385,361 | B2 * | 6/2008 | Noguchi et al. | 315/308 |
| 2002/0101183 | A1 | 8/2002 | Bens et al. | |

FOREIGN PATENT DOCUMENTS

EP 1 185 149 A1 3/2002

* cited by examiner

*Primary Examiner*—Haissa Philogene
(74) *Attorney, Agent, or Firm*—Edwards Angell Palmer & Dodge LLP

(57) ABSTRACT

A discharge lamp ballast is designed to limit or interrupt its AC output power to the discharge lamp upon occurrence of an abnormal discharge outside of an arc tube. A detector is included to examine a lamp voltage once in each of the positive and negative half-cycles or in each one complete cycle of the AC output power, and identifies the abnormal discharge when there is a particular change in the monitored lamp voltage. The particular change may be defined by a single logic or by combination of several logics each designed to represent specific characteristic for the abnormal discharges of several types.

16 Claims, 8 Drawing Sheets

DISCHARGE LAMP BALLAST WITH DETECTION OF ABNORMAL DISCHARGE OUTSIDE THE ARC TUBE

TECHNICAL FIELD

The present invention is directed to a discharge lamp ballast, and more particularly to an electronic lamp ballast that detects an abnormal arc discharge occurring outside of an arc tube for limiting or interrupting an AC output power being fed to the discharge lamp upon detection of the abnormal arc discharge.

BACKGROUND ART

An electronic discharge lamp ballast has been accepted as having an inherent capability of providing a relatively high re-ignition voltage to a discharge lamp reaching its near end of lamp life for prolonging the lamp life. However, this advantage may sometimes cause the lamp to suffer from undue stress which would deteriorate an arc tube of the discharge lamp. The typical deterioration is a leakage of a filling gas out of the arc tube. Once the leakage becomes critical, an abnormal arc discharge would occur within an envelop surrounding the arc tube when supplying the AC output power to the arc tube. That is, the abnormal arc discharge would develop between an electrode of the arc tube and a certain conductive part within the envelope. If such abnormal arc discharge continues, the discharge lamp would be damaged.

Also, if there be any discontinuity in the electric feeding line from the ballast to the discharge lamp due to the disconnection or a dielectric breakage in a covering of the feeding line, like abnormal arc discharge would develop in the feeding line, thereby damaging the ballast, the connection, and/or the discharge lamp itself.

DISCLOSURE OF THE INVENTION

In view of the above problem, the present invention has been accomplished to provide a novel discharge lamp ballast which is capable of discriminating the abnormal arc discharge occurring outside of the arc tube and limiting an AC output power being fed to the discharge lamp for safe operation of the discharge lamp. The ballast according to the present invention is provided for operating the discharge lamp of the type having the arc tube and an envelope surrounding the arc tube. The ballast includes an igniter that provides a high frequency ignition voltage in order to develop an arc in the arc tube for starting the discharge lamp, and an AC power unit that provides a low frequency AC output power to the arc tube for operating the discharge lamp after the lamp is ignited. A detector is included to examine an electric characteristic of an arc discharge occurring outside of the arc tube after the discharge lamp is ignited. The detector analyzes the electrical characteristic to determine an abnormal discharge when there is a critical change in the electrical characteristic. Also included in the ballast is a limiter that limits the AC output power from the AC power unit upon determination of the abnormal discharge, thereby enabling the safe operation of the discharge lamp.

Preferably, the detector is configured to examine the electric characteristic of the arc discharge occurring within the envelope.

The detector may be configured to give a first logic for determination of the abnormal discharge. For this purpose, the detector includes include a lamp monitor for monitoring a lamp parameter which is one of a lamp voltage and a lamp current being applied to the discharge lamp, and an analyzer for determination of the abnormal discharge. The lamp monitor monitors the lamp parameter once within each of positive and negative half-cycles of the AC output power, while the analyzer compares the lamp parameter in each of the positive and negative half-cycles with a predetermined threshold, and increments an error count when the lamp parameter exceeds the threshold. The analyzer determines the abnormal discharge when the error count exceeds a predetermined count.

The detector may be also configured to give a second logic for determination of the abnormal discharge. In this case, the lamp monitor is set to monitor the lamp parameter once within at least one of the positive and negative half-cycles of the AC output power, and the analyzer is set to compare the lamp parameter with a predetermined threshold and to give a flag when the lamp parameter exceeds the threshold. The analyzer compares the next lamp parameter with the threshold and increments an error count when the next lamp parameter does not exceed the threshold and also when the flag has been set with regard to the previous lamp parameter. Then, the analyzer determines the abnormal discharge when the error count exceeds a predetermined count.

Alternatively, the lamp monitor may be configured to monitor the lamp parameter once within each of positive and negative half-cycles. In this case, the analyzer designates the lamp parameter monitored in each of the positive and negative half-cycles as a first lamp parameter, and designating the lamp parameter monitored in the successive one of the positive and negative half-cycles as a second lamp parameter. The analyzer acts to compare the first lamp parameter with a predetermined first threshold to give a first flag when the first lamp parameter exceeds the first threshold, and to compare the second lamp parameter with a predetermined second threshold to give a second flag when the second lamp parameter exceeds the second threshold. Then, the analyzer compares the next first lamp parameter with the first threshold and increments a first error count when the next first lamp parameter does not exceed the threshold and also when the first flag has been set with regard to the previous first lamp parameter. Likewise, the analyzer compares the next second lamp parameter with the second threshold and increments a second error count when the next second lamp parameter does not exceed the second threshold and also when the second flag has been set with regard to the previous second lamp parameter. The analyzer determines the abnormal discharge either when the first error count exceeds a predetermined count or when the second error count exceeds a predetermined count.

Further, the detector may be configured to give a third logic for determination of the abnormal discharge. In this case, the analyzer is set to compare the lamp parameter in each of the positive and negative half-cycles with a first threshold and also with a second threshold which is lower than the first threshold. The analyzer increments a first error count when the lamp parameter is greater than the first threshold, and increments a second error count when the lamp parameter is lower than the second threshold. Then, the analyzer determines the abnormal discharge either when the first error count exceeds a first value or when the second error count exceeds a second value.

Still further, the detector may be configured to give a fourth logic for determination of the abnormal discharge. In this instance, the lamp monitor monitors the lamp parameter once within each of positive and negative half-cycles, and the analyzer is set to designate the lamp parameter monitored in each of the positive and negative half-cycles as a first lamp parameter, and designating the lamp parameter monitored in the successive one of the positive and negative half-cycles as a second lamp parameter. The analyzer obtains the a difference between the first and second lamp parameters, and increments an error count when the difference exceeds a predetermined threshold, thereby determining the abnormal discharge when the error count exceeds a predetermined count.

Further, the detector may be configured to give a fifth logic for determination of the abnormal discharge. In this instance, the detector includes the like lamp monitor and the analyzer which is set to designate the lamp parameter monitored in each of the positive and negative half-cycles as a first lamp parameter, and designate the lamp parameter monitored in the successive one of the positive and negative half-cycles as a second lamp parameter. The analyzer compares the first lamp parameter with the second lamp parameter, and incrementing an error count when the first lamp parameter is greater than the second lamp parameter multiplied by a predetermined value. Then, the analyzer determines the abnormal discharge when the error count exceeds a predetermined count.

Moreover, the detector is preferred to make all of the first, second, third, fourth and fifth logics as mentioned in the above, and to determine the abnormal discharge when anyone of these logics is satisfied.

Preferably, the detector, which is utilized to make anyone of the above logics, may include an initializer that disables the analyzer until the positive and negative half-cycles repeat a predetermined number of times.

These and still other advantageous features of the present invention will become apparent from the detailed description of the preferred embodiment when taken in conjunction with the attached drawings.

MODE FOR CARRYING OUT THE INVENTION

Figure 1:
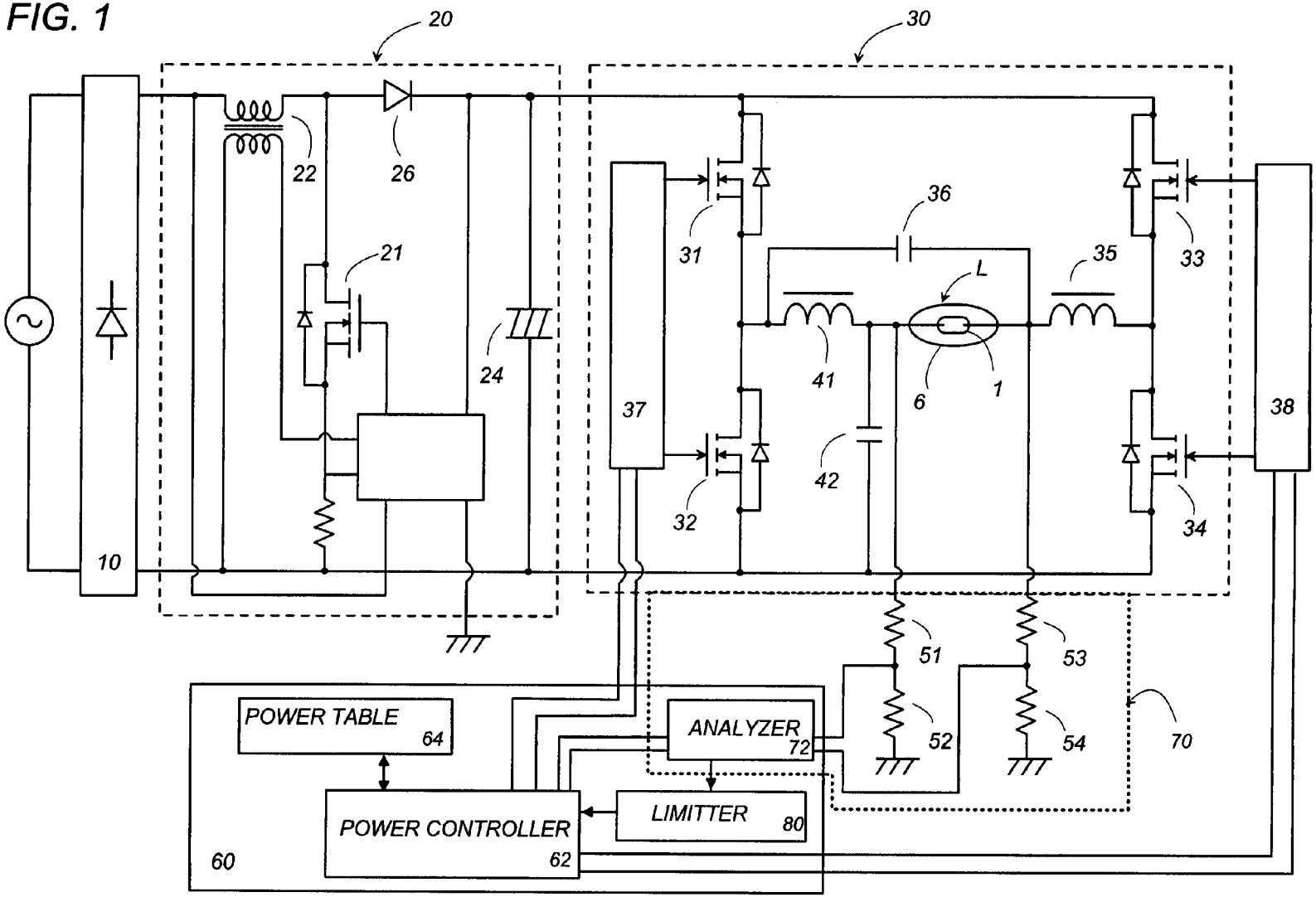
FIG. 1 is a circuit diagram illustrating a discharge lamp ballast in accordance with a preferred embodiment of the present invention.

Now referring to FIG. 1, there is shown a circuit diagram of a discharge lamp ballast according to the preferred embodiment of the present invention. The ballast is designed to operate a discharge lamp, particularly a high-intensity discharge lamp L composed of an arc tube 1 and an envelope 6 surrounding the arc tube. The arc tube 1 is filled with a metal halide in addition to the mercury and an inert gas, while the envelope 6 is evacuated. The ballast includes a rectifier 10 that provides a DC voltage from an AC voltage source, a DC-DC converter 20 that converts the rectified DC voltage into a smoothed DC voltage, and an inverter 30 that provides a low frequency AC output power or voltage to the discharge lamp L. The DC-DC converter 20 is of a type known as a step-up chopper including a switching transistor 21 connected in series with an inductor 22 across the rectifier 10, and a smoothing capacitor 24 connected in series with a diode 26 across the switching transistor 21. The switching transistor 21 is controlled to turn on and off at a suitable frequency to accumulate the smoothed DC voltage across the capacitor 24.

Figure 2:
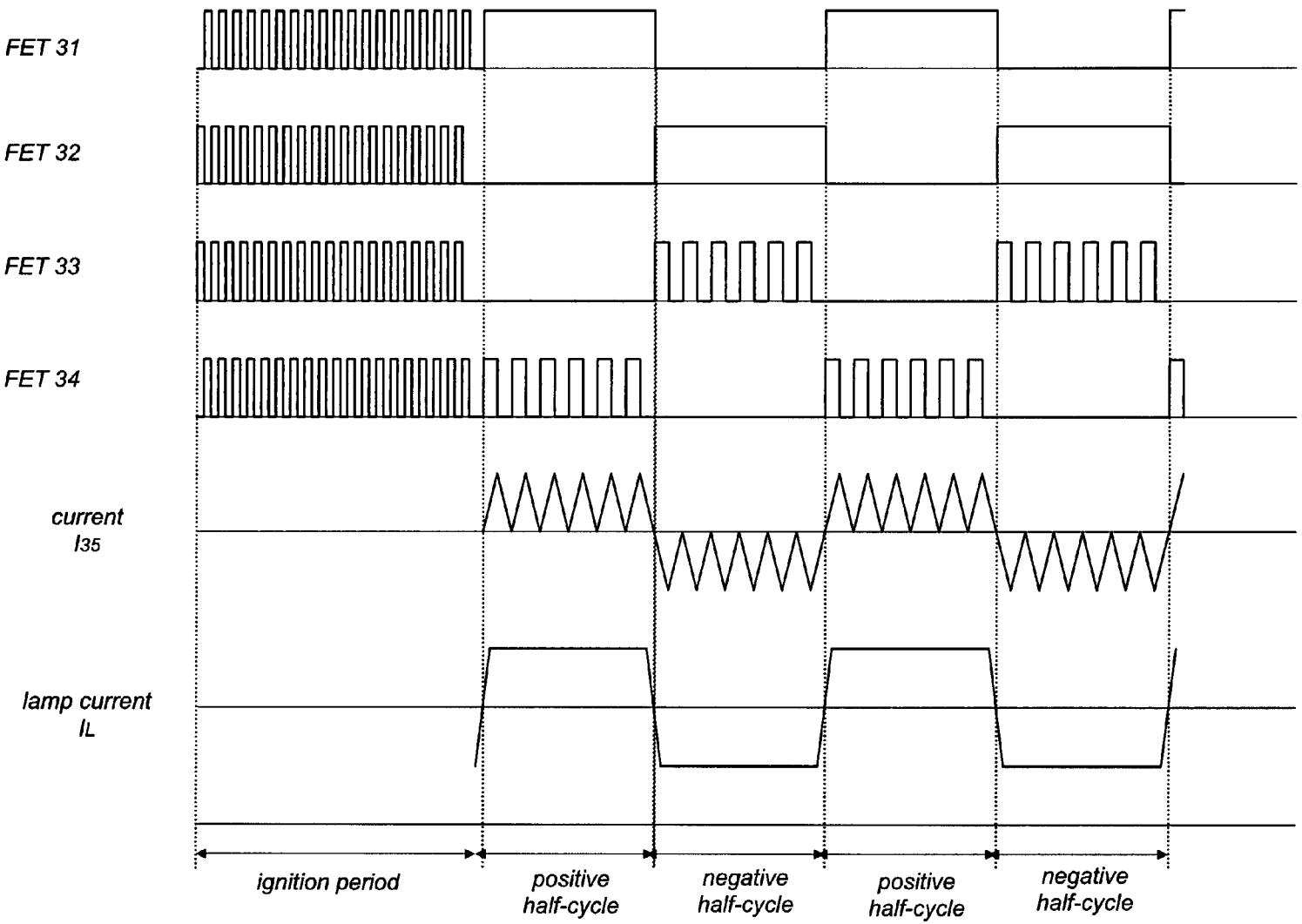
FIG. 2 is a waveform chart illustrating a basic operation of the above ballast.

The inverter 30 includes four switching elements, i.e., FETs 31 to 34 which are arranged in a full-bridge configuration that has an input connected across the smoothing capacitor 24 and has an output connected for applying the AC output voltage to the discharge lamp L, i.e., across electrodes of the arc tube 1. Also included in the inverter 30 is an inductor 35 connected in series with the discharge lamp L between the connection point of the first FET 31 with the second FET 32 and the connection point of the third FET 33 with the fourth FET 34. A capacitor 36 is connected across the discharge lamp L between the connection points. The FETs are driven by drivers 37 and 38 under the control of a controller 60 to turn on and off in a manner as shown in FIG. 2 for providing the low frequency AC output power to the discharge lamp L. As shown in FIG. 2, the AC output power is applied after a high frequency ignition voltage is applied to the discharge lamp. In this sense, the FETs 31 to 34, the inductor 35 and the capacitor 36 constitute an AC power unit that provides the low frequency AC output power to the discharge lamp L.

The high frequency ignition voltage is generated by an igniter which is integrated in the inverter 30 and includes, in addition to the FETs 31 to 34, a series resonant circuit of an inductor 41 and a capacitor 42 connected across the second FET 32. The FETs 31 to 34 are controlled by the controller 60 to turn on and off at a high frequency, as shown in FIG. 2, thereby generating the high frequency ignition voltage to the discharge lamp L. The controller 60 is set to give an ignition period in which the ignition voltage is generated, and subsequently give a lamp operation period in which the low frequency AC output power is generated.

In the ignition period, FETs 31 and 32 are controlled to turn on and off alternately with FETs 34 and 33 being turned on and off alternately in synchronism with FETs 31 and 32, respectively, all at the high frequency, for example, several tens of KHz to several hundreds of KHz to resonate the circuit of inductor 41 and the capacitor 42, thereby inducing the high ignition voltage to ignite the lamp L. The ignition period is set to last about several tens of milliseconds. Although not shown in FIG. 2, the ignition period is followed by a judgment period of about several milliseconds during which one of FETs 31 and FET 32 is kept turned on, and also one of FETs 33 and 34 are driven to turn on and off at a high frequency to provide a lamp voltage, in the like fashion as seen in a first half cycle of the lamp current IL of FIG. 2. It is within this judgment period that the controller 60 investigates the lamp voltage to determine whether or not the lamp is successfully ignited. If the lamp is judged not to be ignited, the controller 60 repeats setting the ignition period at an interval of several hundreds of milliseconds in which all of FETs are set to turned off, until the lamp is ignited or the elapse of a predetermined starting period. The lamp voltage is obtained by a voltage divider network of resistors 51 to 54 connected across the discharge lamp L.

In the lamp operation period, one of the diagonal pair of FETs 31, 34 and the diagonal pair of FETs 32, 33 is made active, while the other is made inactive, thereby providing the low frequency AC power. The controller 60 includes a power table 64 that stores a voltage-wattage relation for the discharge lamp specified, and a power controller 62 that refers to the power table 64 and retrieves a required lamp power in match with the detected lamp voltage for controlling FETs 31 and 34 in order to supply the proper AC lamp power to the discharge lamp L. In this embodiment, the lamp voltage is given by an absolute difference between the voltage across resistor 52 and the voltage across resistor 54. In this sense, the voltage divider network defines a lamp monitor for monitoring the lamp voltage.

The lamp monitor is cooperative with an analyzer 72 to define a detector 70 which examines an electric characteristic of an arc discharge occurring outside of the arc tube 1 after the lamp is ignited, and analyzes the electrical characteristic and determines an abnormal discharge when there is a critical change in the electrical characteristics of the lamp voltage or current. When the abnormal discharge is determined, a limiter 80 in the controller 60 is activated to limit or interrupt the AC power being supplied to the discharge lamp for safe operation of the lamp.

Figure 8:
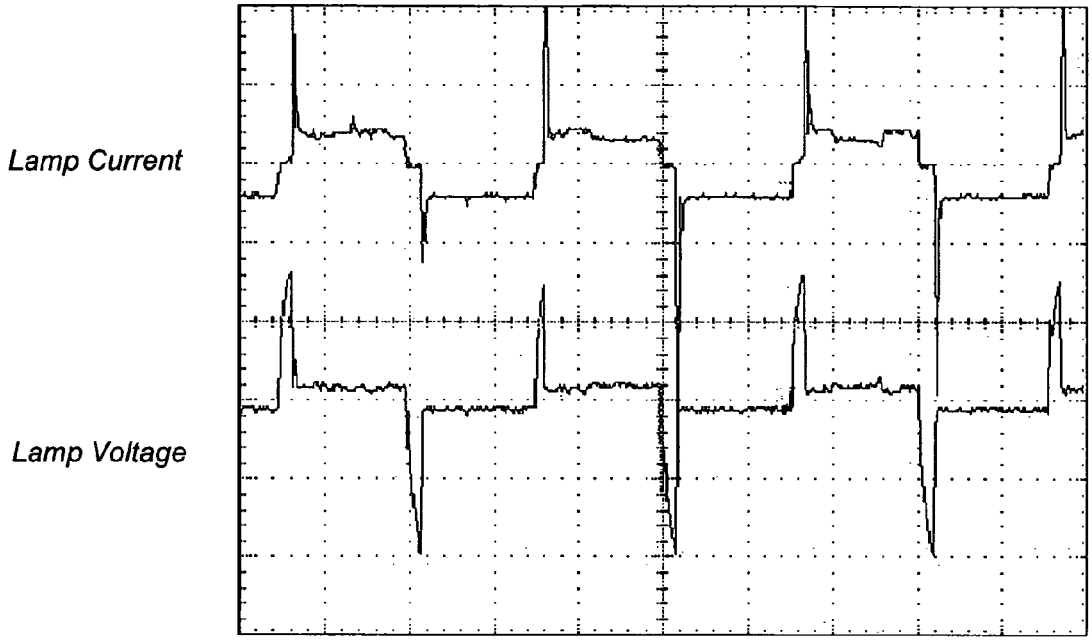
FIGS. 8 to 11 are graphs respectively illustrating lamp characteristics when the discharge lamp suffers from the abnormal discharge.
Figure 9:
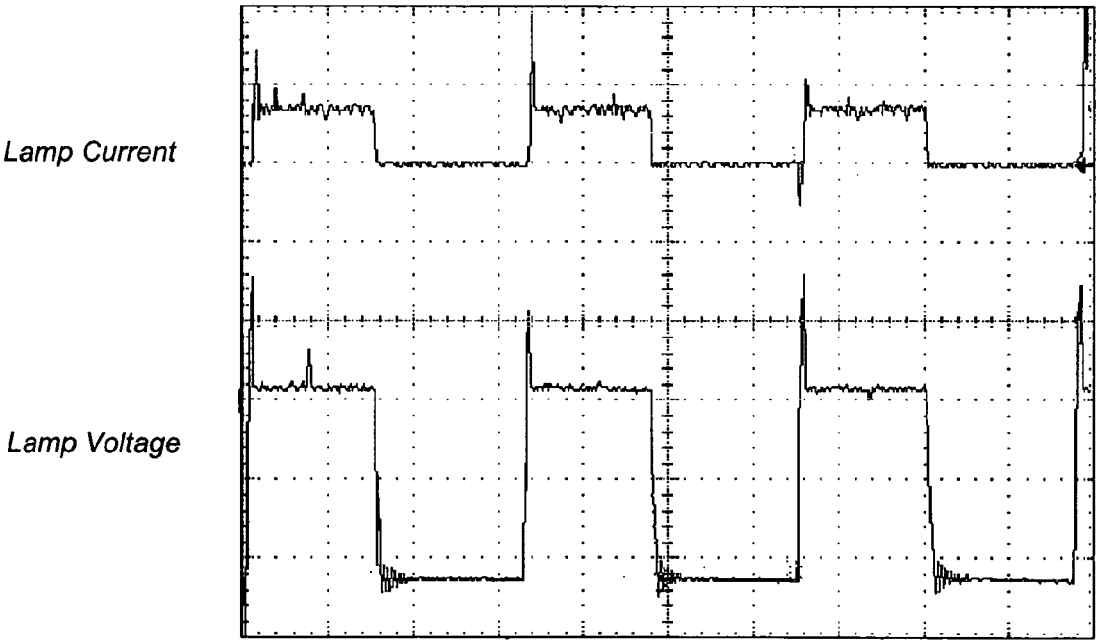
Figure 10:
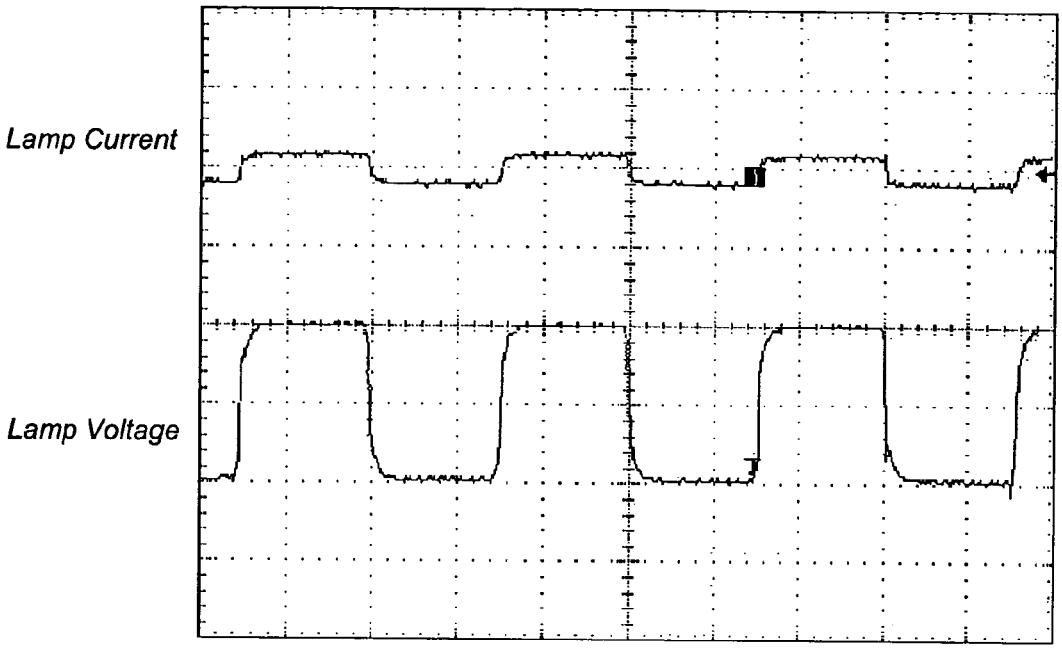

Prior to discussing the detailed functions of the analyzer 72, it is noted that the abnormal discharge occurs when the arc tube is damaged. The abnormal discharge in this case may be referred to as an inside-envelope discharge since the arc discharge will occur within the envelope and not within the arc tube. FIGS. 8 to 10 show some of the electrical characteristics typically seen at the event of the inside-envelope discharge. The characteristics of FIGS. 8 and 9 are identified to have an abrupt increase of the lamp voltage (re-ignition voltage) immediately after the voltage reversal of the lamp voltage, and to have an abrupt overshooting of the lamp current immediately after the extinction of the abrupt voltage increase. In the condition of FIG. 8, the arc discharge becomes unstable, resulting in the repetition of the lamp extinction and re-ignition. In the condition of FIG. 9, a half-wave discharge occurs within the envelope, assisting to sustain the arc discharge. In addition, the lamp voltage is seen to fluctuate to a large extent in both cases.

The characteristic of FIG. 10 is identified to have an unduly high lamp voltage far beyond the rated lamp voltage. This condition results from the arc discharge occurring immediately adjacent to the electrode of the arc tube within the envelope, and such arc discharge is rather stable not to cause the lamp extinction, which should be avoided.

The analyzer 72 realizes five independent logics each analyzing the electric characteristic of the lamp parameter, i.e., the lamp voltage for determination of the abnormal discharge, and causes the limiter 80 to limit or interrupt the AC output power when any one of the five logics determines the abnormal discharge.

Figure 3:
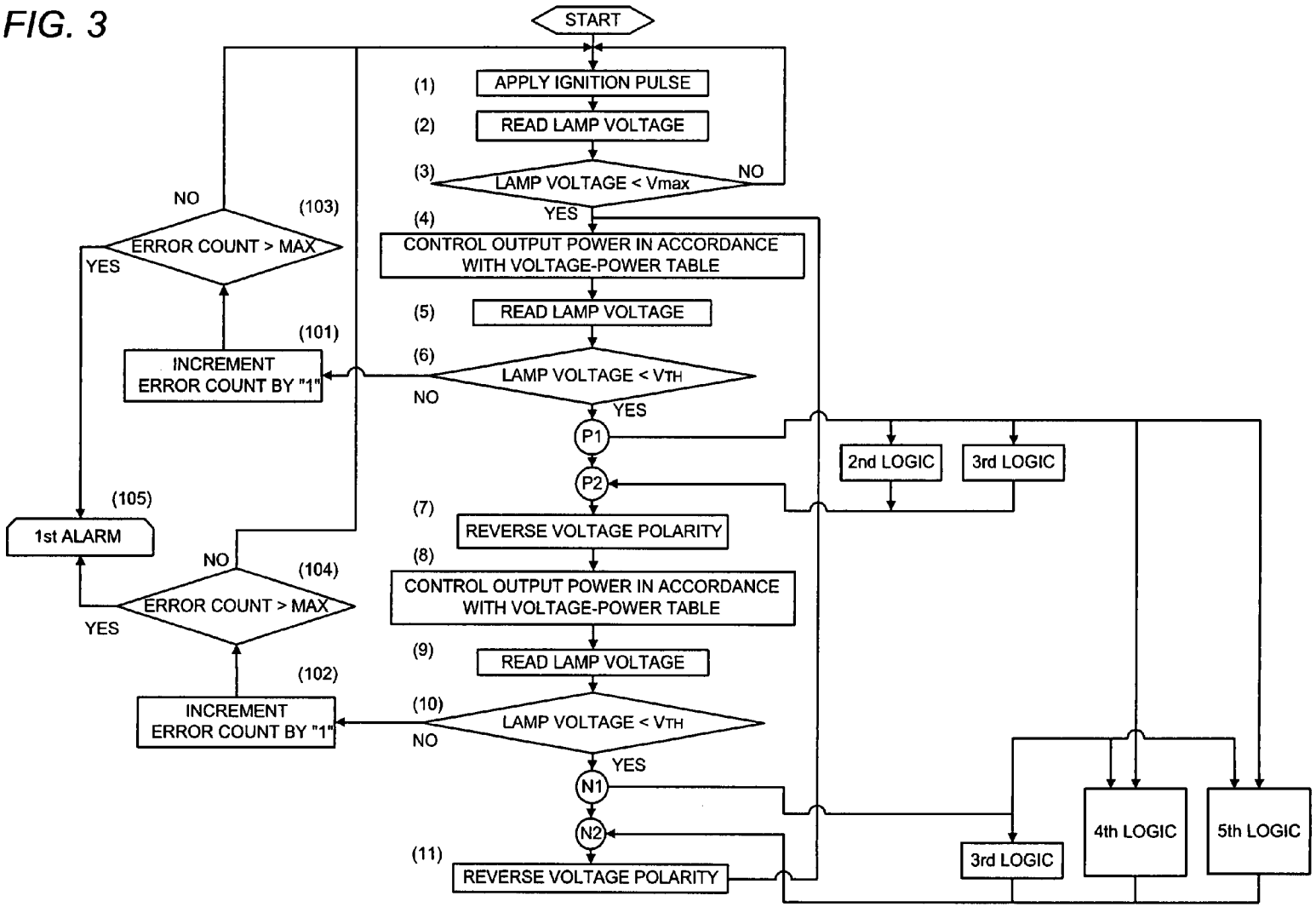
FIG. 3 is a flow chart illustrating various schemes of determining an abnormal discharge according the present invention.

The analyzer 72 is configured to execute the logics during a control sequence of igniting and operating the lamp. As shown in FIG. 3, the control sequence is composed of steps (1) to (11). Firstly, the igniter is activated at step (1) to apply the ignition voltage for starting the lamp, followed by step (2) in which the lamp voltage is read by the analyzer 72. As step (3), the lamp voltage (Vla) is compared with a predetermined maximum voltage (Vmax). When Vla>Vmax, no ignition is recognized and the sequence returns to step (1). Otherwise, the ignition is found to be successful, and step (4) is executed to provide the lamp voltage in the positive half-cycle, as shown in FIG. 2, for feeding the lamp current or power to discharge lamp under the control of the power controller 62. Then, step (5) is executed to read the lamp voltage once monitored in the positive half-cycle in order to compare the lamp voltage (Vla) with a predetermined threshold (VTH) at step (6). When Vla>VTH, the analyzer 72 recognizes the abnormal discharge and initiates the first logic, as will be discussed later. Otherwise, no abnormal discharge is found to take place and the sequence goes to step (7) to reverse the polarity, i.e., the controller 60 responds to feed the lamp current in the negative half cycle, as shown in FIG. 2. Thereafter, steps (8) to (11), which are similar to steps (4) to (7), are executed for monitoring and comparing the lamp voltage in the negative half-cycle with the threshold ($V_{TH}$).

Operation of the First Logic

The first logic is explained with reference to FIG. 3. The first logic watches the steps (6) and (10) and includes the steps (101) to (105). When the lamp voltage once monitored in the positive half-cycle of the AC output power exceeds the threshold (Vla=$V_{TH}$) at step (6), the analyzer 72 makes the step (101) of incrementing an error count by one. Likewise, when (Vla=$V_{TH}$) at step (10), the step (102) is made to increment an error count by one. While the AC output power repeats a number of the positive and negative half-cycles, steps (103) and (104) are made to check whether or not the error count exceeds a predetermined count (max). If anyone of the steps (103) and (104) finds the error count exceeding the predetermined count, the sequence goes to a step (105) where the analyzer 72 responds to issue a first alarm to the limiter 80, causing the controller 60 to limit or interrupt the AC output power being fed to the discharge lamp. Otherwise, the sequence goes back to the step (1) for re-ignition of the lamp.

Operation of the Second Logic

Figure 4:
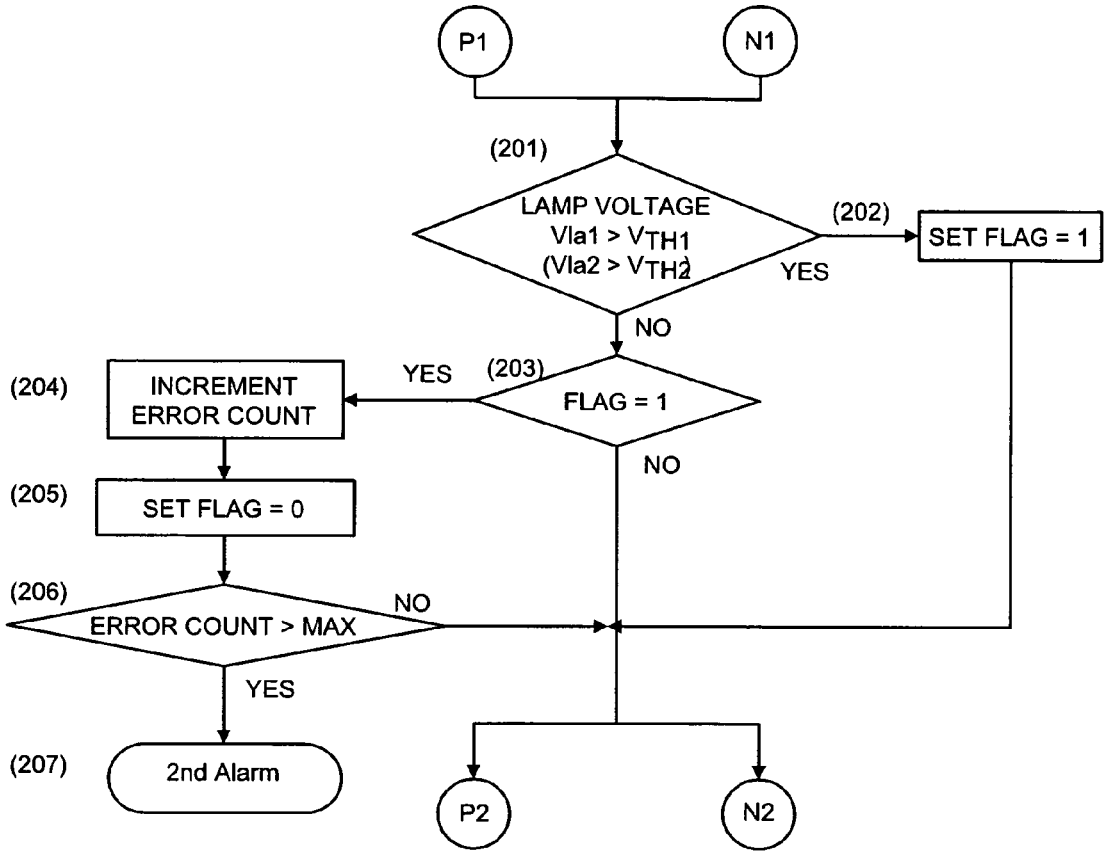
FIGS. 4 to 7 are flow charts respectively illustrating the details of above schemes.

Referring to FIG. 3, the second logic is inserted between the steps (6) and (7) and also between the steps (10) and (11) for checking the lamp voltage once monitored in each of the positive and negative half-cycles. As shown in FIG. 4, the second logic includes the steps (201) to (207). At step (201), the lamp voltage (Vla1) in each positive half-cycle, and the lamp voltage (Val2) in each negative half-cycle are compared respectively with predetermined first threshold (VTH1) and second threshold (VTH2) which may be equal. When Via1>VTH1, a flag is set to "1" at step (202) and the sequence goes back to step (7) or (11) of FIG. 3. Likewise, when Vla2>VTH2, the flag is set to "1" at step (202) and the sequence goes back to step (7) or (11).

In the next positive and negative half-cycles, it is firstly checked at step (201) whether Vla1>VTH1 or Vla2>VTH2. If one of these equations is not satisfied, then it is checked at step (203) whether or not the flag has been set to "1" in the previous corresponding one of the positive and negative half-cycles. If the flag has not been set to "1", the sequence goes back to step (7) or (11) of FIG. 3. Otherwise, an error count is incremented by one at step (204), followed by step (205) where the flag is reset to "0". Subsequently, it is checked at step (206) whether or not the error count exceeds a predetermined count (max). If the error count exceeds the predetermined count, the sequence proceeds to a step (207) where the analyzer 72 responds to issue a second alarm to the limiter 80, thereby causing the controller 60 to limit or interrupt to the AC output power being fed to the discharge lamp. Otherwise, the sequence goes back to step (7) or (11).

Operation of the Third Logic

Figure 5:
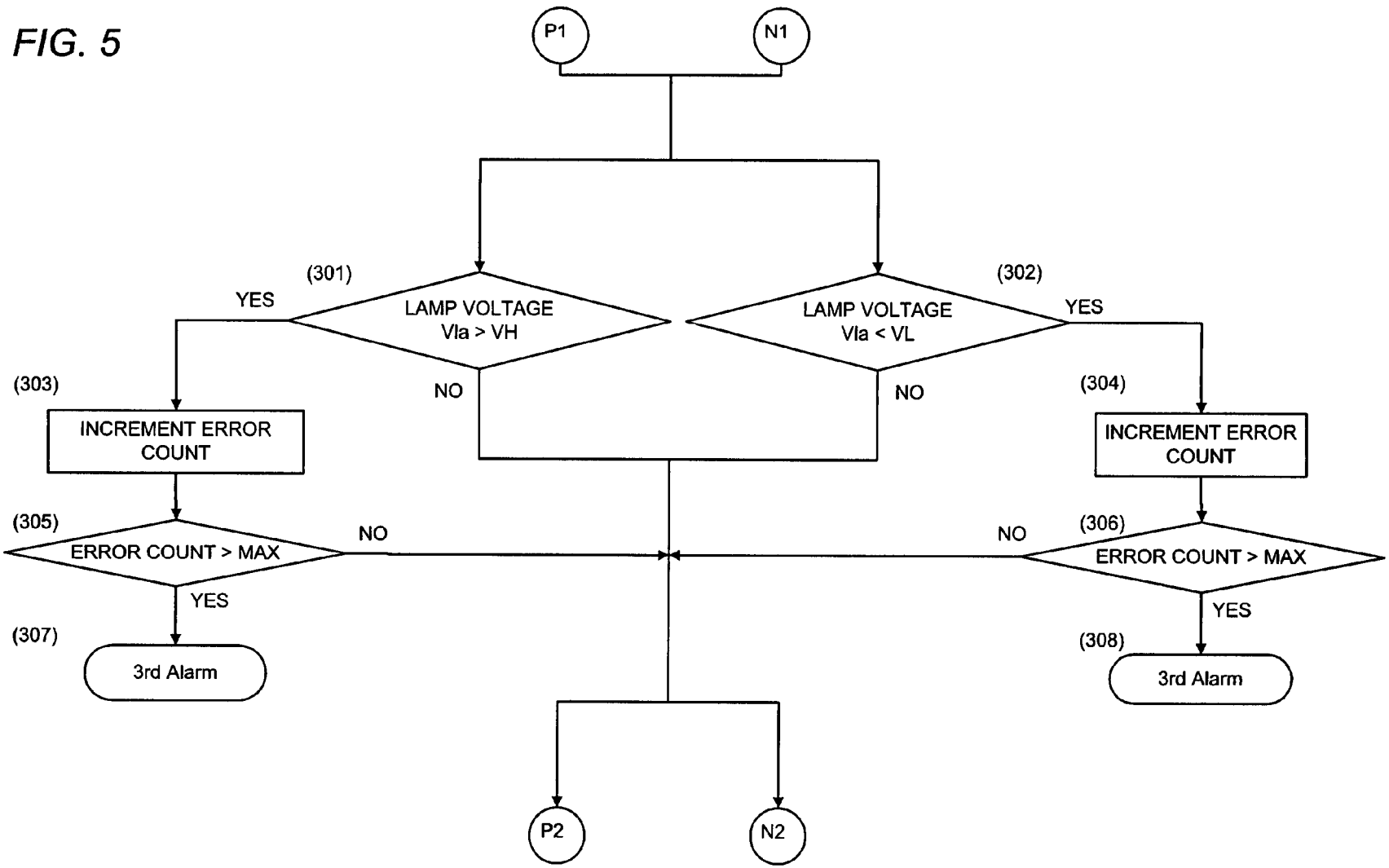

The third logic is also inserted between the steps (6) and (7) and also between the steps (10) and (11) for checking the lamp voltage once monitored in each of the positive and negative half-cycles. As shown in FIG. 5, the third logic firstly checks at step (301) and (302) respectively whether or not the lamp voltage (Vla) is higher than a predetermined high threshold ($V_H$) and whether or not the lamp voltage (Vla) is lower than a predetermined low threshold ($V_L$). If $V_L$<Via<$V_H$ indicating that the lamp voltage is within the normal range, the sequence goes back to step (7) or (13). If Vla=VH, an error count is incremented by one at step (303) and thus incremented error count is compared with a predetermined count (max) at step (305). If the error count=max, the sequence proceeds to a step (307) where the analyzer 72 responds to issue a third alarm to the limiter 80, thereby causing the controller 60 to limit or interrupt to the AC output power being fed to the discharge lamp. Otherwise, the sequence goes back to step (7) or (13). Likewise, if Vla=VL, an error count is incremented by one at step (304) and thus incremented error count is compared with a predetermined count (max) at step (306). If the error count=max, the sequence proceeds to a step (308) where the analyzer 72 responds to issue the third alarm to the limiter 80, thereby causing the controller 60 to limit or interrupt to the AC output power being fed to the discharge lamp. Otherwise, the sequence goes back to step (7) or (11).

Operation of the Fourth Logic

Figure 6:
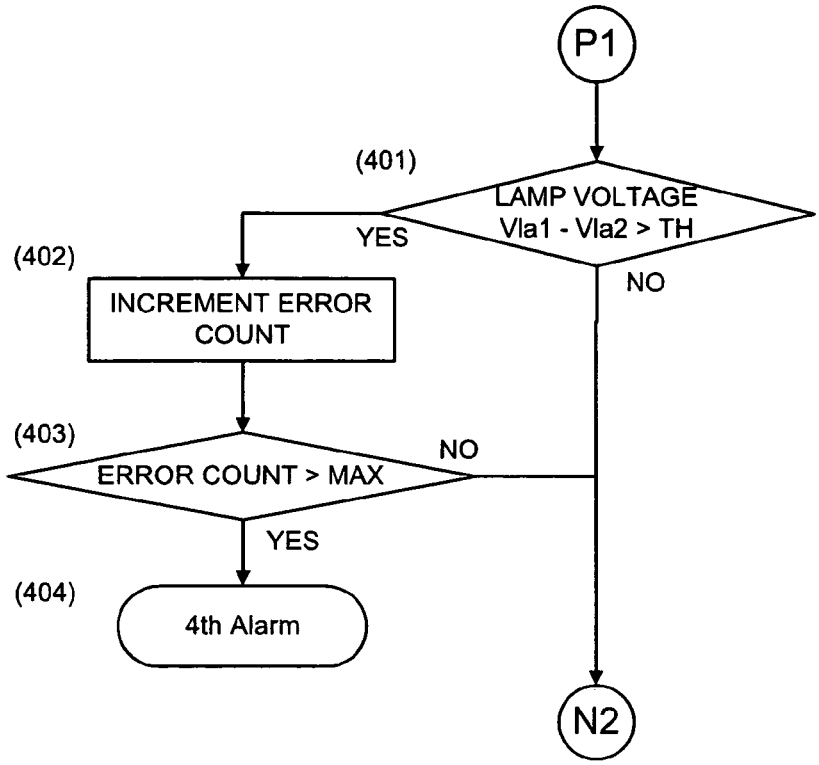

The fourth logic is inserted in a bypath extending across the steps (7) and (10) of FIG. 3 in order to examine the lamp voltage once monitored within each one complete cycle of the AC output power being fed to the discharge lamp. Referring to FIG. 6, the fourth logic starts with a step (401) where the lamp voltage (Vla1) once monitored in the positive half-cycle is compared with the lamp voltage (Vla2) once monitored in the negative half-cycle to examine whether the difference (Vla1−Vla2) between the voltages is greater than a predetermined threshold (TH). If Vla1−Val2<TH, the sequence goes back to step (11) of FIG. 3. Otherwise, i.e., the difference is found critical, an error count is incremented by one at step (402). At step (403), it is checked whether the error count increases to exceed a predetermined count (max) while the AC output power continues to be supplied. When the error count exceeds the predetermined count, the sequence proceeds to a step (404) where the analyzer 72 responds to issue a fourth alarm to the limiter 80, thereby causing the controller 60 to limit or interrupt to the AC output power being fed to the discharge lamp. Otherwise, the sequence goes back to step (11).

Operation of the Fifth Logic

Figure 7:
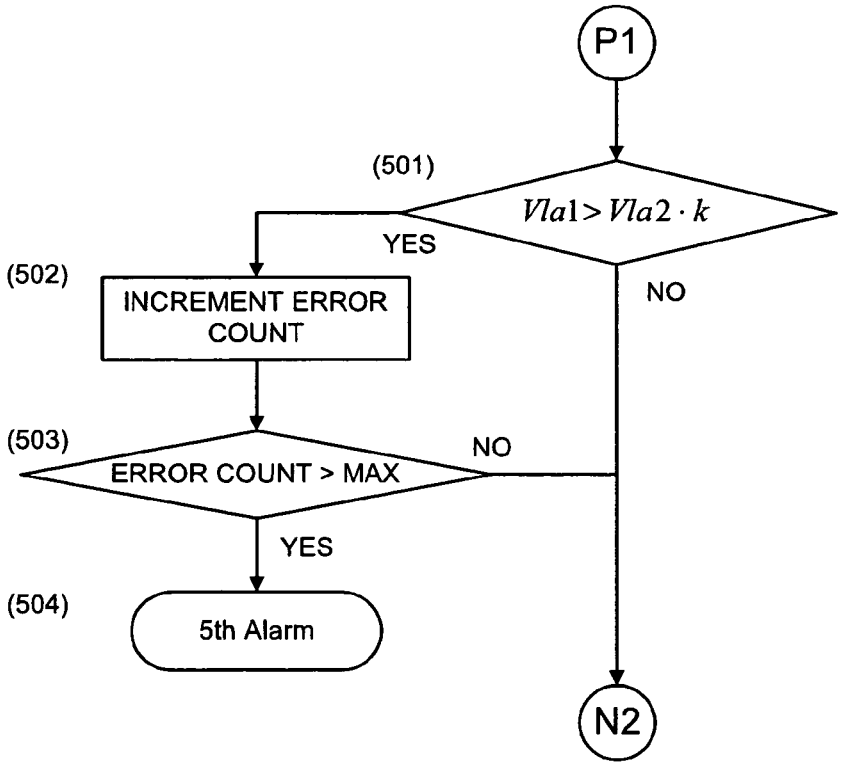

The fifth logic is also inserted in the bypath across the steps (7) and (10) of FIG. 3 in order to examine the lamp voltage once monitored within each one complete cycle of the AC output power being fed to the discharge lamp. Referring to FIG. 7, the fifth logic starts with a step (501) where the lamp voltage (Vla1) once monitored in the positive half-cycle is compared with the lamp voltage (Vla2) once monitored in the negative half-cycle to examine whether Vla1>Val2·k is satisfied, wherein k is a constant. If Vla1=Vla2·k, the sequence goes back to step (11) of FIG. 3. Otherwise, the difference between the voltages is found critical, and an error count is incremented by one at step (502). At step (503), it is checked whether the error count increases to exceed a predetermined count (max) while the AC output power continues to be supplied. When the error count exceeds the predetermined count, the sequence proceeds to a step (504) where the analyzer 72 responds to issue a fifth alarm to the limiter 80, thereby causing the controller 60 to limit or interrupt to the AC output power being fed to the discharge lamp. Otherwise, the sequence goes back to step (11).

Thus, when any of the above logics give the alarm, the controller 60 responds to limit or interrupt the AC output power for safe operation of the discharge lamp.

In addition, the controller 60 is programmed to give an initialize module that disables the analyzer 72 until the positive and negative half-cycles repeat a predetermined number of times.

Figure 11:
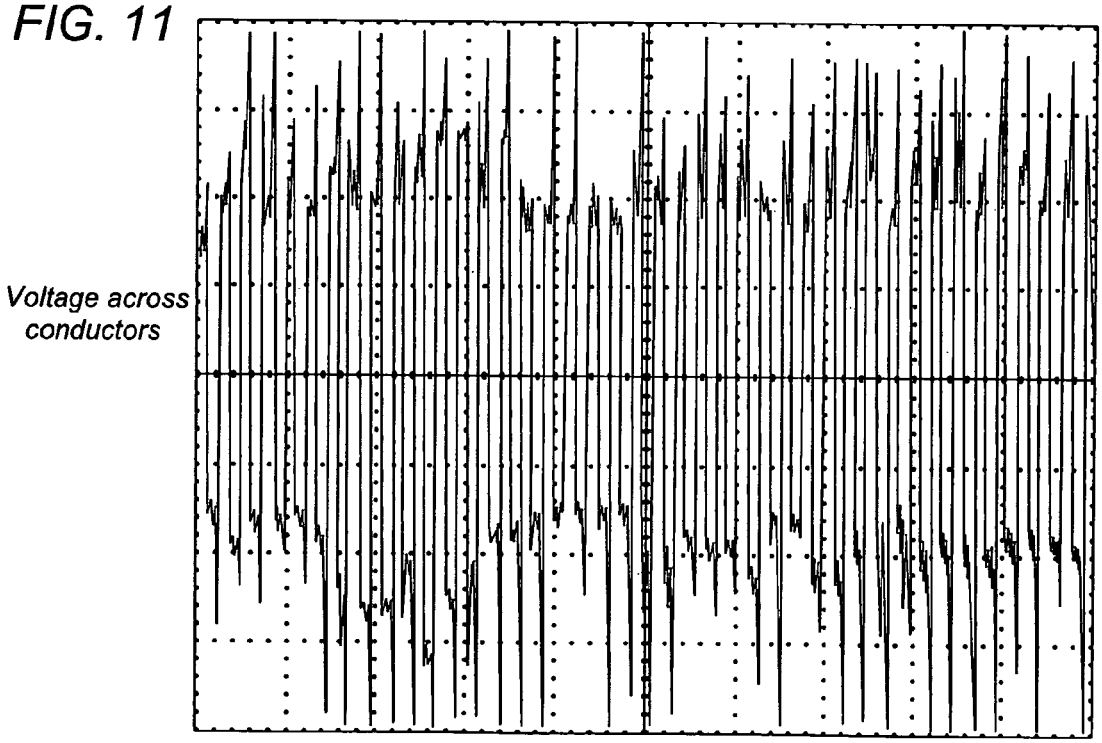

Beside the inside-envelope discharge as explained in the above, there is another abnormal discharge which would occur when there is a defect in an electric feeding line from the ballast to the lamp. In this case, the arc discharge will occur between conductors in the electrical feeding line. When the discharge is seen outside of the envelope, it shows electrical characteristic as shown in FIG. 11, in which voltage fluctuates greatly across the conductors. Therefore, it is also made to limit the AC lamp power upon occurrence of the abnormal discharge of this type by detecting the voltage change in the electric feeding line. For this purpose, the detector 70 may be additionally equipped with a line voltage monitor for monitoring the voltage difference between the conductors.

Although the above embodiment is explained to rely on the lamp voltage or the other voltage as the lamp parameter for detection of the abnormal discharge, it is equally possible to rely on the lamp current or the equivalent thereof. Therefore, the present invention should not be limited to the use of the lamp voltage alone, and should be interpreted to encompass the use of the lamp current or the equivalent thereof.

Further, it should be noted that one or any combination of the above logics may be suffice to identify the abnormal discharge and to limit or interrupt the AC output power.

The invention claimed is:

1. A discharge lamp ballast for operating a discharge lamp composed of an arc tube and an envelope surrounding said arc tube, said ballast comprising:

an igniter that provides a high frequency ignition voltage in order to develop an arc in said arc tube for starting said discharge lamp;

an AC power unit that provides a low frequency AC output power to said arc tube for operating the discharge lamp after said lamp is ignited, a detector that examines an electric characteristic of an arc discharge occurring outside of said arc tube after said discharge lamp is ignited, said detector analyzing said electrical characteristic to determine an abnormal discharge when there is a critical change in said electrical characteristic, and a limiter that limits said AC output power from said AC power unit in response to the determination of said abnormal discharge.

2. The ballast as set forth in claim 1, wherein said detector is configured to examine said electric characteristic of said arc discharge occurring within said envelope.

3. The discharge lamp ballast as set forth in claim 2, wherein said detector includes a lamp monitor for monitoring a lamp parameter which is one of a lamp voltage and a lamp current being applied to said discharge lamp, and an analyzer for determination of said abnormal discharge, said lamp monitor monitoring said lamp parameter once within each of positive and negative half-cycles of said AC output power, said analyzer comparing said lamp parameter in each of said positive and negative half-cycles with a predetermined threshold, and incrementing an error count when said lamp parameter exceeds said threshold, and said analyzer determining said abnormal discharge when said error count exceeds a predetermined count.

4. The discharge lamp ballast as set forth in claim 2, wherein said detector includes a lamp monitor for monitoring a lamp parameter which is one of a lamp voltage and a lamp current being applied to said discharge lamp, and an analyzer for determination of said abnormal discharge, said lamp monitor monitoring said lamp parameter once within at least one of positive and negative half-cycles of said AC output power, said analyzer comparing said lamp parameter with a predetermined threshold to give a flag when said lamp parameter exceeds said threshold, said analyzer comparing the next lamp parameter with said threshold and incrementing an error count when said next lamp parameter does not exceed said threshold and when said flag has been set with regard to the previous lamp parameter, and said analyzer determining said abnormal discharge when said error count exceeds a predetermined count.

5. The discharge lamp ballast as set forth in claim 2, wherein said detector includes a lamp monitor for monitoring a lamp parameter which is one of a lamp voltage and a lamp current being applied to said discharge lamp, and an analyzer for determination of said abnormal discharge, said lamp monitor monitoring said lamp parameter once within each of positive and negative half-cycles of said AC output power, said an analyzer designating the lamp parameter monitored in each of said positive and negative half-cycles as a first lamp parameter, and designating the lamp parameter monitored in the successive one of said positive and negative half-cycles as a second lamp parameter, said analyzer comparing said first lamp parameter with a predetermined first threshold to give a first flag when said first lamp parameter exceeds said first threshold, and comparing said second lamp parameter with a predetermined second threshold to give a second flag when said second lamp parameter exceeds said second threshold, said analyzer comparing the next first lamp parameter with said first threshold and incrementing a first error count when said next first lamp parameter does not exceed said first threshold and when said first flag has been set with regard to the previous first lamp parameter, said analyzer comparing the next second lamp parameter with said second threshold and incrementing a second error count when said next second lamp parameter does not exceed said second threshold and when the second flag has been set with regard to the previous second lamp parameter, said analyzer determining said abnormal discharge either when said first error count exceeds a predetermined count or when said second error count exceeds a predetermined count.

6. The discharge lamp ballast as set forth in claim 2, wherein said detector includes a lamp monitor for monitoring a lamp parameter which is one of a lamp voltage and a lamp current being applied to said discharge lamp, and an analyzer for determination of said abnormal discharge, said analyzer comparing said lamp parameter in each of said positive and negative half-cycles with a first threshold and also with a second threshold which is lower than said first threshold, said analyzer incrementing a first error count when said lamp parameter is greater than said first threshold, and incrementing a second error count when said lamp parameter is lower than said second threshold, and said analyzer determining said abnormal discharge either when said first error count exceeds a first value or when said second error count exceeds a second value.

7. The discharge lamp ballast as set forth in claim 2, wherein said detector includes a lamp monitor for monitoring a lamp parameter which is one of a lamp voltage and a lamp current being applied to said discharge lamp, and an analyzer for determination of said abnormal discharge, said lamp monitor monitoring said lamp parameter once within each of positive and negative half-cycles of said AC output power, said an analyzer designating the lamp parameter monitored in each of said positive and negative half-cycles as a first lamp parameter, and designating the lamp parameter monitored in the successive one of said positive and negative half-cycles as a second lamp parameter, said analyzer obtaining a difference between said first lamp parameter and said second lamp parameter, and incrementing an error count when said difference exceeds a predetermined threshold, said analyzer determining said abnormal discharge when said error count exceeds a predetermined count.

8. The discharge lamp ballast as set forth in claim 2, wherein said detector includes a lamp monitor for monitoring a lamp parameter which is one of a lamp voltage and a lamp current being applied to said discharge lamp, and an analyzer for determination of said abnormal discharge, said lamp monitor monitoring said lamp voltage once within each of positive and negative half-cycles of said AC output power, said analyzer designating the lamp parameter monitored in each of said positive and negative half-cycles as a first lamp parameter, and designating the lamp parameter monitored in the successive one of said positive and negative half-cycles as a second lamp parameter, said analyzer comparing said first lamp parameter with said second lamp parameter, and incrementing an error count when said first lamp parameter is greater than said second lamp parameter multiplied by a predetermined value, said analyzer determining said abnormal discharge when said error count exceeds a predetermined count.

9. The discharge lamp ballast as set forth in claim 2, wherein said detector includes a lamp monitor for monitoring a lamp parameter which is one of a lamp voltage and a lamp current being applied to said discharge lamp, and an analyzer for determination of said abnormal discharge, said lamp monitor monitoring said lamp parameter once within each of positive and negative half-cycles of said AC output power, said an analyzer designating the lamp parameter monitored in each of said positive and negative half-cycles as a first lamp parameter, and designating the lamp parameter monitored in the successive one of said positive and negative half-cycles cycle as a second lamp parameter, a) said analyzer having a first logic that compares each of said first and second lamp parameters with a predetermined threshold and increments an error count when the lamp parameter exceeds said threshold, said first logic issuing a first alarm when said error count exceeds a predetermined count, b) said analyzer having a second logic that compares one of said first and second lamp parameters with a predetermined threshold to set a flag when said one of said first and second lamp parameters exceeds said threshold, said second logic comparing the next corresponding one of said first and second lamp parameters with said threshold to increment an error count when said next corresponding one of said first and second lamp parameters does not exceed said threshold and when the flag has been set with regard to the previous corresponding one of said first and second lamp parameters, said second logic issuing a second alarm when said error count exceeds a predetermined count;

c) said analyzer having a third logic that compares one of said first and second lamp parameters with a first threshold and also with a second threshold which is lower than said threshold, said third logic incrementing a first error count when said one of the first and second lamp parameters is greater than said first threshold, and incrementing a second error count when said one of the first and second lamp parameters is lower than said second threshold, said third logic issuing a third alarm either when said first error count exceeds a predetermined count or when said second error count exceeds a predetermined count, d) said analyzer having a fourth logic that obtains a difference between said first lamp parameter and said second lamp parameter and increments an error count when said difference exceeds a predetermined threshold, said fourth logic issuing a fourth alarm when said error count exceeds a predetermined count, e) said analyzer having a fifth logic that compares said first lamp parameter with said second parameter and increments an error count when said first lamp parameter is greater than said second lamp parameter multiplied by a predetermined value, said fifth logic issuing a second alarm when said error count exceeds a predetermined count, said analyzer determining said abnormal discharge when any one of said first, second, third, fourth, and fifth alarm is issued.

10. The discharge lamp ballast as set forth in claim 3, wherein said detector includes an initializer that disables said analyzer until said positive and negative half-cycles repeat a predetermined number of times.

11. The discharge lamp ballast as set forth in claim 4, wherein said detector includes an initializer that disables said analyzer until said positive and negative half-cycles repeat a predetermined number of times.

12. The discharge lamp ballast as set forth in claim 5, wherein said detector includes an initializer that disables said analyzer until said positive and negative half-cycles repeat a predetermined number of times.

13. The discharge lamp ballast as set forth in claim 6, wherein said detector includes an initializer that disables said analyzer until said positive and negative half-cycles repeat a predetermined number of times.

14. The discharge lamp ballast as set forth in claim 7, wherein said detector includes an initializer that disables said analyzer until said positive and negative half-cycles repeat a predetermined number of times.

15. The discharge lamp ballast as set forth in claim 8, wherein said detector includes an initializer that disables said analyzer until said positive and negative half-cycles repeat a predetermined number of times.

16. The discharge lamp ballast as set forth in claim 9, wherein said detector includes an initializer that disables said analyzer until said positive and negative half-cycles repeat a predetermined number of times.

* * * * *